United States Patent [19]

Minnebraker

[11] Patent Number: 4,515,383

[45] Date of Patent: May 7, 1985

[54] WHEELCHAIR CONSTRUCTION

[75] Inventor: Jeffrey P. Minnebraker, Van Nuys, Calif.

[73] Assignee: Quadra Wheelchairs, Inc., Westlake Village, Calif.

[21] Appl. No.: 613,464

[22] Filed: May 24, 1984

Related U.S. Application Data

[63] Continuation of Ser. No. 378,433, May 14, 1982, Pat. No. 4,477,098, which is a continuation-in-part of Ser. No. 206,346, Nov. 13, 1980, Pat. No. 4,351,540.

[51] Int. Cl.[3] ..... A61G 5/02

[52] U.S. Cl. ..... 280/242 WC; 280/42; 297/DIG. 4

[58] Field of Search ..... 280/242 WC, 40, 42, 280/647, 649, 650; 297/DIG. 4

[56] References Cited

U.S. PATENT DOCUMENTS 3,618,968 11/1971 Greer ..... 280/242 WC
4,042,250 8/1977 Rodaway ..... 280/42
4,166,631 9/1979 Sanaski ..... 280/242 WC

FOREIGN PATENT DOCUMENTS 593384 10/1947 United Kingdom ..... 280/42

*Primary Examiner*—John A. Pekar
*Attorney, Agent, or Firm*—Robert J. Schaap

[57] ABSTRACT

A wheelchair capable of being constructed in several different sizes from components of standard size in order to permit users of different sizes and users with one or more handicaps to conveniently use such wheelchairs. In addition, the wheelchair is constructed with a frame and related components so that it is capable of being folded to a collapsed position for storage and transport and expanded for operation and use. The wheelchair is uniquely adapted for normal wheelchair operation and is highly effective for use in sports or athletic activities. Adjustability of both the front wheels and the rear wheels permits different riding and maneuverability characteristics for both normal in-use transport and sports activities.

26 Claims, 15 Drawing Figures

WHEELCHAIR CONSTRUCTION

RELATED APPLICATION

This application is a continuation of my co-pending application Ser. No. 378,433, filed May 14, 1982 for "Wheelchair Construction", now U.S. Pat. No. 4,477,098 dated Oct. 16, 1984, which was a continuation-in-part of copending application Ser. No. 206,346, filed Nov. 13, 1980 for "Wheelchair Construction", now U.S. Pat. No. 4,351,540, dated Sept. 28, 1982.

BACKGROUND OF THE INVENTION

1. Field of the Invention

This invention relates in general to certain new and useful improvements in wheelchairs, and more particularly, to improved and foldable wheelchairs which can be constructed in a variety of sizes from standard sized components and which also have front and back wheels adjustably positionable thereon, and which can be used in normal riding conditions and in sports activities.

2. Brief Description of the Prior Art

Wheelchair constructions have remained unchanged, except for relatively minor features, for a substantial period of time. While wheelchairs have existed for many years, they generally were constructed of a main frame, front and rear wheels, side rails or so-called "arm rests" and foot support members. However, there was no means for creating or manufacturing wheelchairs of different sizes, at a relatively low cost, from standard sized components, in order to accommodate different size users, or users with various forms of disabilities. While the prior art has disclosed foldable wheel chairs, the prior art has not provided a wheelchair which is foldable and which also has all of the advantages of manufacturing wheelchairs of different sizes from commonly sized components and which can be used in normal riding conditions and in sports activities.

Prior art wheelchair manufacturers constructed several different sized wheelchairs and used different sized components for each of the differently sized wheelchairs. In the case of a tall individual, the main frame had to be larger, the seat located in a different position, and a foot support member extended further from the seat, than in the case of a wheelchair for a smaller individual. In addition, for the larger sized wheelchair, the seat may have to be located at a higher elevation in order to permit the user to engage rims on the wheels for propelling the wheelchair in an easy and convenient manner.

Notwithstanding, heretofore there has not been any foldable and operable wheelchair which was designed for normal transport and for sports activities and which was durable and presented a high degree of stability. In other words, such wheelchairs heretofore constructed were not designed to permit any form of athletic activity, and particularly, for fast-moving sports activities and which were stable and durable. This was primarily due to the fact that the prior art wheelchairs were all of a box-like construction with the seat, and hence, the center of gravity, located at a fixed and at a substantial distance above the ground. Consequently, the prior art wheelchairs were not designed for any fast movement, and if one attempted to propel any of the prior art wheelchairs and particularly foldable and expandable wheelchairs, at any significant speed, or attempted to turn a corner quickly, the wheelchair might well tipover, resulting in injury to the user.

In recent years, it has been found to be highly beneficial for paraplegics and others required to use wheelchairs on a relatively permanent basis to engage in various forms of athletic activities, including wheelchair racing, tennis, and the like. However, the wheelchair constructions heretofore did not lend themselves to such forms of activities. More specifically, it was found to be necessary to provide wheelchairs of this type which are collapsible and foldable and also openable for use.

For the more seriously handicapped people, particularly with high level back injuries which limited the mobility of the handicapped users arms, the conventional wheelchairs are difficult to use. This is due to the heavy construction and resultant weight of the conventional wheelchairs, which make it more difficult for the injured party to use and to manuever. As a result, people with such injuries had to resort to the use of motor powered wheelchairs, as for example, electric motor powered wheelchairs which use a battery source of power. These motor powered wheelchairs are quite expensive and require periodic maintenance, which thereby militates against widespread use. Further, these wheelchairs require frequent recharging, when battery powered.

U.S. Pat. No. 3,937,490 to Nasr discloses a wheelchair having some degree of adjustibility to suit several body sizes and deformities. Particularly, the width of the seat and back rest panels may be adjusted, and the length of the seat may be adjusted. However, this patent does not disclose a wheelchair which can be made from a common main frame and a variety of commonly sized components which are capable of being mounted in a desired location in the same manner as taught and claimed in the instant application. U.S. Pat. No. 4,046,374 to Breyley discloses a walking aid which includes caster wheels. In addition, the walking aid is provided with telescopically located adjustable members.

U.S. Pat. No. 2,847,058 to R. E. Lee discloses a folding wheelchair which includes cross-bars extending between frame sections. However, the wheelchair uses a complex construction and the means for folding the wheelchair and moving it into an expanded and opened position for use is not sufficient to create a desire degree of stability, particularly in sports activities.

U.S. Pat. No. 3,331,614 to J. L. McClintock also discloses a foldable wheelchair using cross-lever arms. Hereagain, the single pair of cross-lever arms connecting the two opposed frame sections does not provide the necessary rigidity even in normal use conditions, let alone sports activities.

U.S. Pat. No. 2,181,420 to Everest et al discloses one of the basic forms of foldable wheelchairs. This particular wheelchair also utilizes a pair of cross-lever arms for connecting two opposed wheel frame sections. Consequently, it suffers from the same disadvantages in that stability and rigidity are not obtainable with this type of construction.

U.S. Pat. No. 4,166,631 dated Sept. 4, 1979 to David Sanaski also discloses a foldable wheelchair which can be used in sports activities. This wheelchair also features a pair of cross-lever arms connecting a seat structure to a pair of opposed frame sections. However, this wheelchair suffers from many disadvantages including the primary fact that it is really not very stable in normal transport and even less stable in sports activities. Specifically, the single pair of cross-lever arms connecting the opposed frame sections and the seat structure is not sufficient to maintain the desired rigidity even in normal transport when being used by an occupant of the wheelchair.

The wheelchair of the Sanaski Patent requires four points of connection of the main frame to the seat structure in order to achieve at least some desired rigidity. In other words, the frame of the buttocks supporting portion of the seat structure is necessarily connected to the pair of opposed frames on at least four quadralaterally located points. Notwithstanding, even this construction is not sufficient to provide the necessary rigidity. In fact, the Sanaski Patent specifically points out that the "sway bar" effect is desired. While this may be effective on some occasions, it is not effective in sports activities. In addition, due to the fact there is this flexibility in the construction, the wheelchair is not very responsive to quick turns or manuevability. Moreover, it does not provide the desired support and stability which would be desired by users in normal operation.

U.S. Pat. No. 2,561,616 to Everest et al and U.S. Pat. No. 2,486,015 to Everest et al also disclose collapsable or socalled "foldable" wheelchairs similar to that in the Sanaski Patent. The wheelchairs in each of these Everest et al Patents also employ only a single pair of cross-lever arms or links and therefore suffer from the same disadvantages as does the wheelchair taught in the Sanaski Patent.

OBJECTS OF THE INVENTION

It is, therefore, a primary object of the present invention to provide a collapsable wheelchair for storage and which is expandable and openable wheelchair for use and which may be constructed of a main frame and a plurality of commonly sized auxiliary components adjustably attached to the main frame in order to accommodate different sized users.

It is another object of the present invention to provide a wheelchair of the type stated in which a seat section can be adjustably attached to the main frame in a variety of positions and a foot support member which can be adjustably attached to the main frame in a number of positions, and with at least front or rear wheels capable of being adjustably attached to the main frame in a variety of positions.

It is a further object of the present invention to provide a wheelchair having both rear and front wheels which are capable of being shifted longitudinally and vertically in order to change the wheel base of the wheelchair, the angle of attack of the wheelchair, and the center of gravity thereof.

It is an additional object of the present invention to provide a wheelchair of the type stated in which the front wheels can be adjustably positioned, and in which a front wheel mounting means is capable of receiving different sized front wheels.

It is still another object of the present invention to provide a wheelchair construction of the type stated which is uniquely adapted for transport and for normal use and also for athletic activities, by adjustably positioning the front or rear wheels or both.

It is still another object of the present invention to provide a method of manufacturing foldable wheelchairs from a limited number of common components such that the wheelchairs can be of differing sizes in order to suit different sized users.

It is still another salient object of the present invention to provide a quick release means for quickly releasing and reattaching the rear wheels of the wheelchair.

It is yet another object of the present invention to provide a foot support structure for attachment to the wheelchair in such manner that the structure can be attached in a plurality of positions to accommodate the user thereof.

With the above and other objects in view, my invention resides in the novel features of form, construction, arrangement and combination of parts presently described and pointed out in the claims.

SUMMARY OF THE DISCLOSURE

A wheelchair which is constructed so that it is capable of being collapsed and folded for storage and for non-user transport, that is where the wheelchair is not carrying a user and is being transported by means other than the wheels of the wheelchair itself, e.g. in a motor vehicle. The wheelchair is also capable of being expanded and opened for use in sports activities and in normal transport in which a user sits in and propels the wheelchair.

The wheelchair of the present invention comprises a main frame and several additional components which are capable of being attached to the main frame. These additional components include a seat structure which more specifically includes a seat pad and a seat back supporting member. These components also include a foot support structure, arm rests and front and rear wheel assemblies. The seat structure and the foot supporting structure are capable of being adjustably positioned on the main frame in order to accommodate differently sized users. The front and rear wheel assemblies are also capable of being adjustably positioned with respect to the main frame in order to affect manueverability and riding characteristics of the wheelchair, as hereinafter described in more detail. The various components which are adapted for attachment to the wheelchair are designed so that the wheelchair can be easily folded for storage or nonuser transport and opened for use.

One of the unique aspects of the present invention is that the wheelchair can be constructed from several commonly sized components. For example, by using one main frame of a common size, and adjustably positioning the seat structure and the front and rear wheel assemblies on the main frame, it is possible to design the chair for differently sized users while employing commonly sized components. The same holds true of the seat structure and the foot supporting structure. In addition, it is possible to use differently sized components with a single sized main frame. Thus, the wheelchair can not only be constructed in order to suit differing sized users, it is also capable of being constructed to accommodate different forms of disabilities or deformities of the user.

The main frame generally comprises a pair of (first and second) spaced apart and opposed main frame sections, such as a left-hand section and a right-hand section. Each main frame section is comprised of spaced apart upper and lower generally horizontally extending frame legs connected at their front and rearward ends by generally upright legs.

An upper frame structure forms part of, or cooperates with, the main frame and comprises a pair of longitudinally extending upper frame bars. Each of these longitudinally extending upper frame bars generally lie above and in generally parallel relationship to each of the main frame sections. The upper frame structure also serves as a seat pad supporting structure, as hereinafter described in more detail.

Two pairs of cross-lever arms or so-called "connecting rods" are employed to connect the two main frame sections together in both a foldable and an openable relationship. A first pair of the spaced apart connecting rods are connected to the lower frame bar of the first frame section e.g. the right-hand frame section and extend diagonally upwardly and are connected to a second of the upper frame bars (e.g. left-hand upper frame bar) of the upper frame structure and which overlies the second frame section. In like manner, the second pair of spaced apart connecting rods are connected to the lower frame bar of the second or left-hand frame section and at their upper ends to the first or right-hand upper frame bar of the upper frame structure.

The first pair of connecting rods are pivotally connected to the lower portion of the right main frame section at spaced apart locations (longitudinally, that is between front and rear). These connecting rods are also pivotally connected at their upper ends to the upper frame structure on the left-hand side thereof and are longitudinally spaced apart from each other. Similarily, the second pair of connecting rods are pivotally connected to the lower portion of the left-hand main frame section and are pivotally connected at their upper ends to the right-hand portion of the upper frame structure.

Each of the pairs of first and second connecting rods are pivotally connected intermediate their upper and lower ends, and preferably approximately in their center portions. More specifically, a first of the first pair of connecting rods is connected to one of the second pair of connecting rods adjacent thereto and the other of the first connecting rods is pivotally connected to the other of the second connecting rods adjacent thereto. In this way, the two main frame sections can be capable of being folded to a position where they lie in very closely spaced apart juxtaposed relationship and to an opened position where they are spaced apart from each other by a distance to permit a user to sit on a seat structure of the wheelchair.

Each of the upper frame bars on the upper frame structure have a single downwardly extending post which extends within a receiving tube on the main frame section and each combination of downwardly extending post and associated receiving tube constitutes a telescopic connection between the frame section and upper frame structure. Thus, by using pairs of cross-lever arms, or connecting arms or rods, which are spaced somewhat close to each other, in the manner as shown, it is possible to use only one single T-joint in which a post on the each side of the upper frame structure can be telescopically connected with respect to the associated main frame. This is clearly not possible in the prior art constructions. Further, the pairs of cross-lever arms or connecting rods are located intermediate the front and rear portions of the two main frame sections.

The generally upright legs on each of the main frame sections are preferably tubular members. In this way, a pair of back supporting seat rods, forming part of a seat structure, can be adjustably positioned within the rear generally upright legs on each of the frame sections for adjustably positioning a back supporting pad forming part of the seat structure. In like manner, the lower ends of the generally upright front legs on the main frames are tubular so as to telescopically receive a foot supporting member, in a manner as hereinafter described in more detail. A main seat pad can be extended across the two longitudinally extending upper frame bars forming part of the upper frame structure. This seat pad could also be important in serving as the means for controlling the opening limit of the two main frame sections.

The foot support structure used in the illustrated and described wheelchair is also important in that it is comprised of a pair of foot support members. Each of these foot support members are designed so that they can be attached to either side of the wheelchair and further, in positions so as to be capable of adapting to the comfort and/or a disability of a user of the wheelchair.

The present invention also provides an apparatus for selectively positioning the rear wheels of a wheelchair to selectively alter the center of gravity thereof. This apparatus comprises a rear wheel mounting means in the nature of at least a bracket having a pair of spaced apart plates. One of such brackets is mounted on each of the opposite sides of the main frame. A plurality of axle receiving locations are provided in each of the spaced apart plates of each bracket and are capable of receiving a rear wheel axle in any of such locations. A pair of rear wheel axles are provided and each is capable of extending through the rear wheel axle locations in the associated one of each of said plates. Further, a quick release means is associated with the rear wheel axles to enable quick release and replacement of rear wheels on these rear wheel axles.

The rear wheel axles and rear wheels carried thereby can be easily removed from one location and replaced in another axle receiving location so that the response and center of gravity and the wheel base on said frame can be easily and quickly altered, by use of the quick release means described herein. In more detail, the axle receiving locations comprises a plurality of pairs of spaced apart openings in each of the spaced apart plates of each bracket to receive the rear wheel axles. These plates are located on opposite sides of the main frame. Further, a retaining means may be associated with each of the brackets. The retaining means is preferably an integral flange on each of the opposite sides of the main plate and in parallel relationship thereto, and are provided with a plurality of apertures to receive fasteners for attachment to the frame sections.

In another embodiment of the invention, the quick release means are preferably located on each rear wheel axle. The quick release means may comprise at least a retaining element extending outwardly from the axle and capable of being retracted to permit removal of the wheel on the axle. Preferably, two or more of such retaining elements, in the form of actuated locking balls, is provided. A manually actuable means, such as a shiftable pin in each shaft, causes said retaining elements to be retracted upon actuation thereof.

The quick release means for mounting the rear wheels to the associated pairs of plates of each mounting bracket is also designed so that the manually engagable portion of the quick release retaining pin can be engaged from the exterior portion of the wheelchair. In addition, the entire quick release means is sized so that the wheelchair can be completely folded without any obstruction from the quick release means. Further, the quick release means is designed so that it can be adjustably attached to the pair of spaced apart plates of each mounting bracket with the required amount of tightness.

The front wheels on each of the wheelchairs can also be adjustably positioned to alter the angle of attack of the wheelchair relative to a ground plane. As used herein, the term "ground plane" refers to a ground surface or other supporting surface upon which the wheelchair would be used and is generally a horizontal surface. Further, the position of the front wheels can be altered relative to the rear wheels in order to change the wheel base. Thus, for example, the rear wheels can be shifted closer to or further from the front wheels and/or the front wheels can be shifted closer to or further from the rear wheels. In addition to the above, the front wheels and the rear wheels can be shifted in the same or different directions to affect the positions of the front and rear wheels relative to the main frame in order to vary the riding characteristics of the wheelchair.

The apparatus for selectively positioning the front wheels comprises or employs a pair of front wheel assemblies and each assembly comprises a wheel post housing on the main frame means. A post extends outwardly from each of these wheel post housings. A separate bracket is carried by each of the posts and is rotatable about a generally vertical axis relative to the associated wheel post housing. Each of the brackets has a pair of spaced apart plates with a plurality of aligned apertures in said spaced apart plates. A separate wheel and axle is also provided for each bracket, and each front wheel axle capable of being disposed in any of the plurality of aligned apertures. In this way, it is possible to adjust the plane of the frame, and hence, the angle of attack of the wheelchair relative to the ground plane. In another embodiment of the invention, these front wheel brackets are sized so that different sized front wheels can be removably mounted with respect to the brackets.

It is also possible to cant (often referred to as "camber") the rear wheels so that the lower portions are disposed outwardly with respect to the main frame, and the upper portions are disposed inwardly toward the frame. This type of canting or cambering of the rear wheels also provides increased stability, particularly when the wheelchair is used in athletic activities. In addition to the cambering, the wheels can be toed in or out, as may be desired.

This invention possesses many other advantages and has other purposes, which may be made more clearly apparent from a consideration of the forms in which it may be embodied. These forms are shown in the drawings forming and accompanying part of the present specification. They will now be described in detail for the purposes of illustrating the general principles of the invention, but it is to be understood that such detailed descriptions are not to be taken in a limiting sense.

BRIEF DESCRIPTION OF THE DRAWINGS

Figure 1:
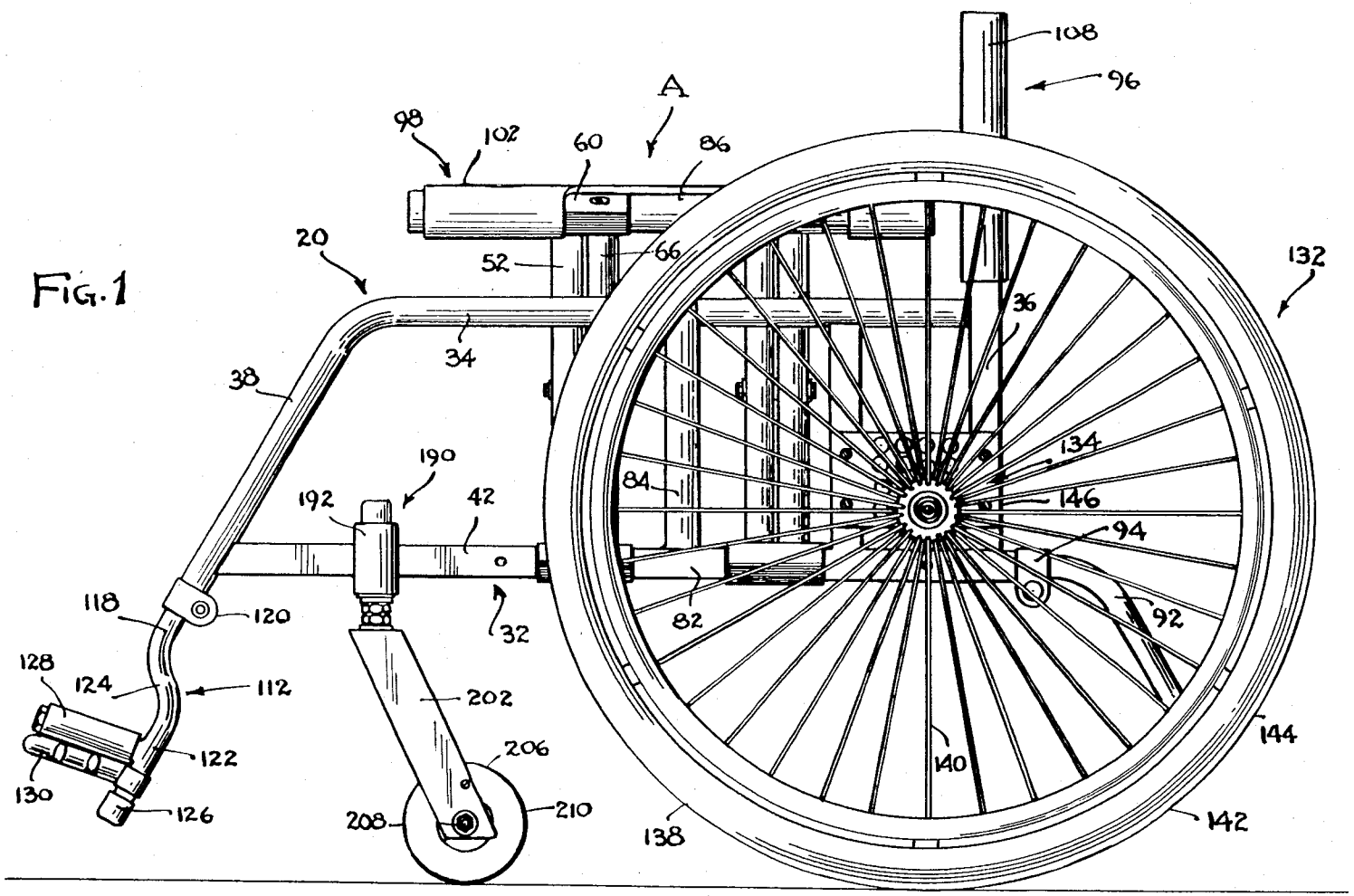
Figure 2:
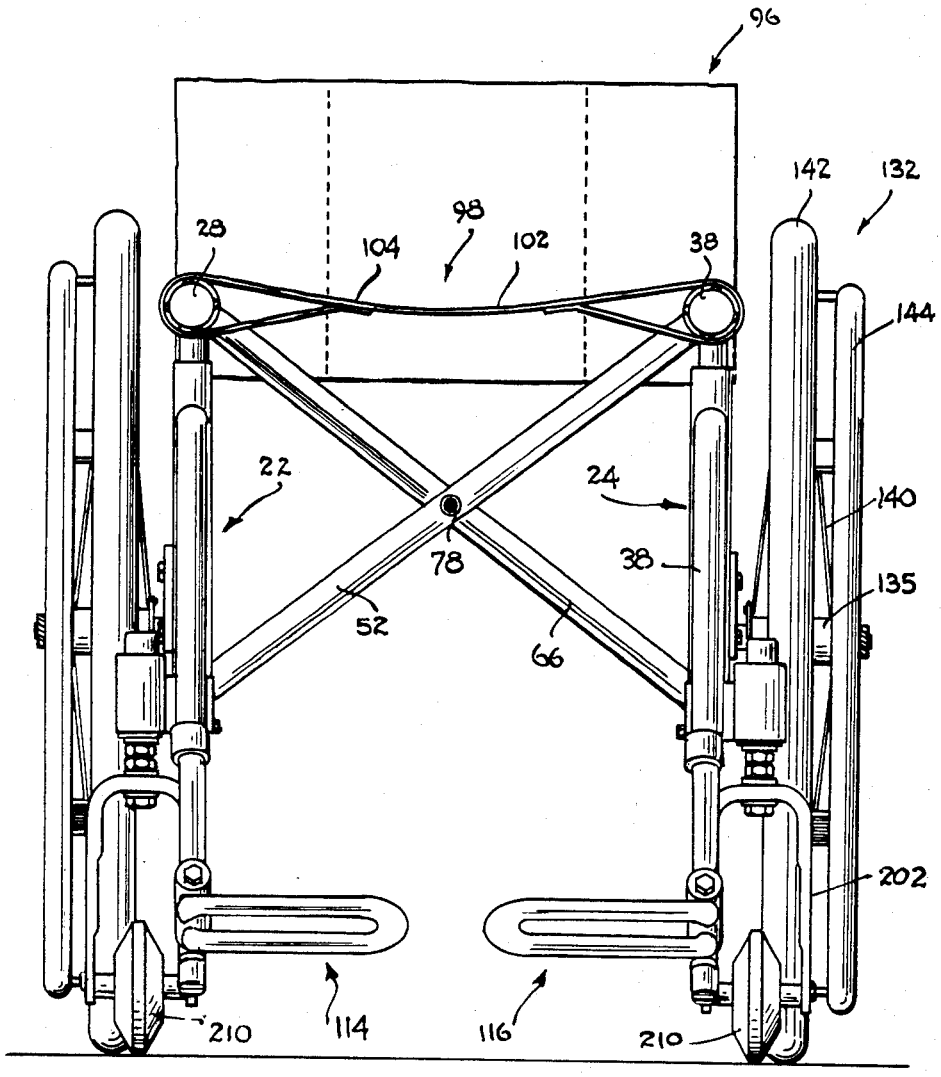
Figure 3:
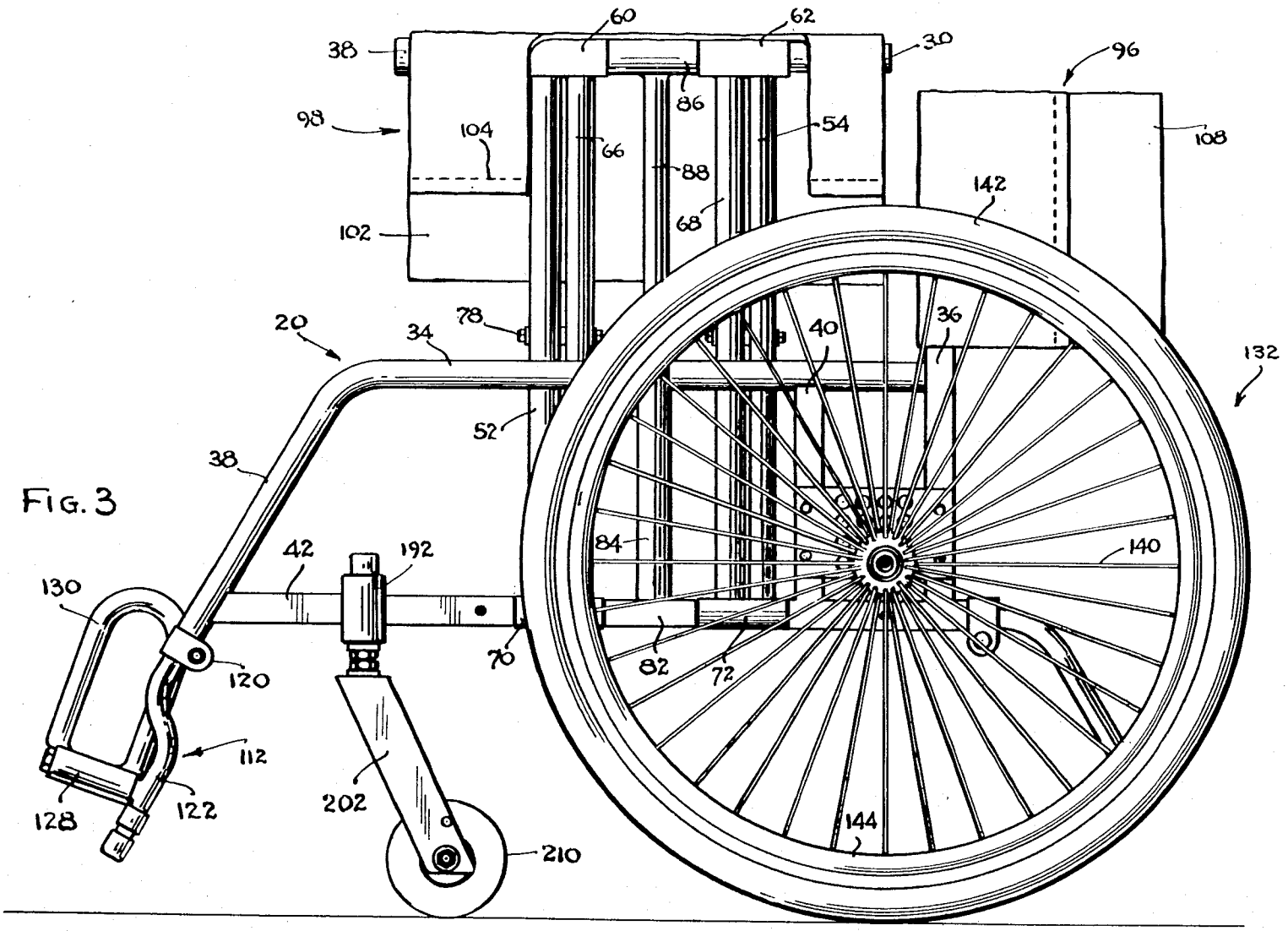
Figure 4:
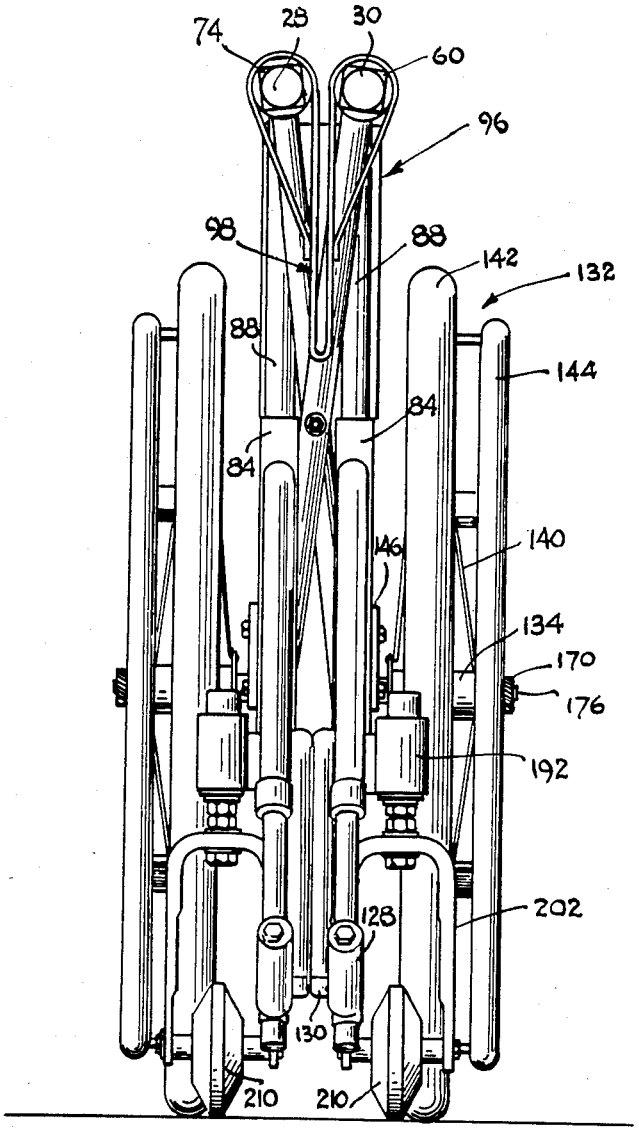
Figure 5:
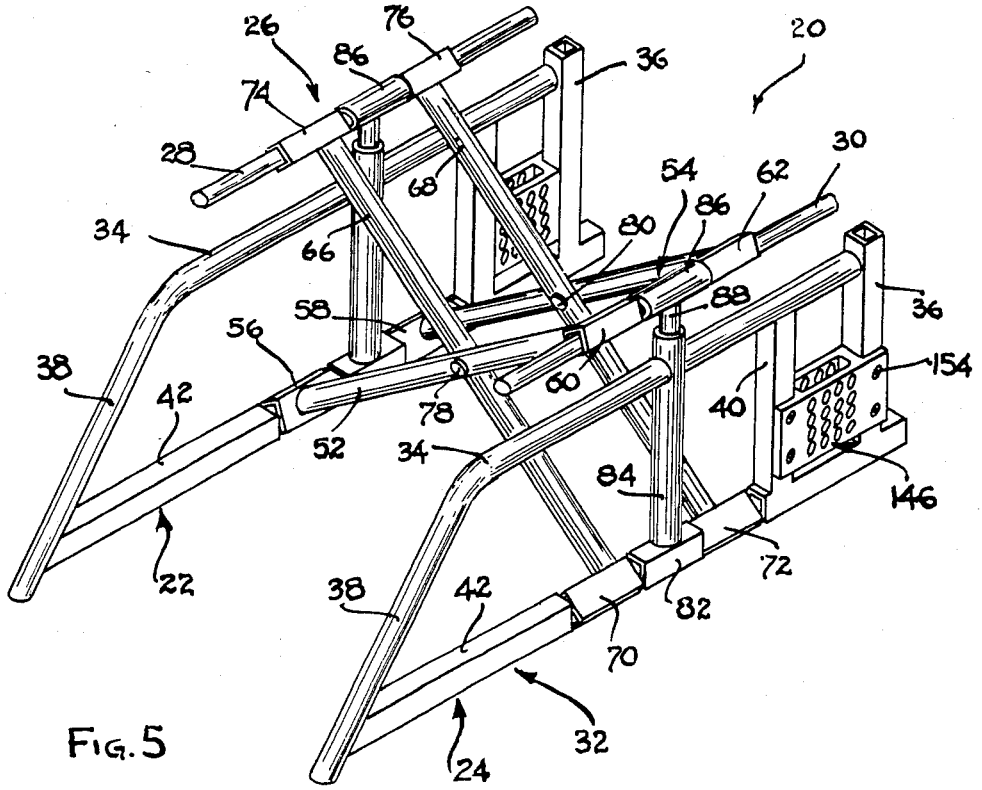
Figure 15:
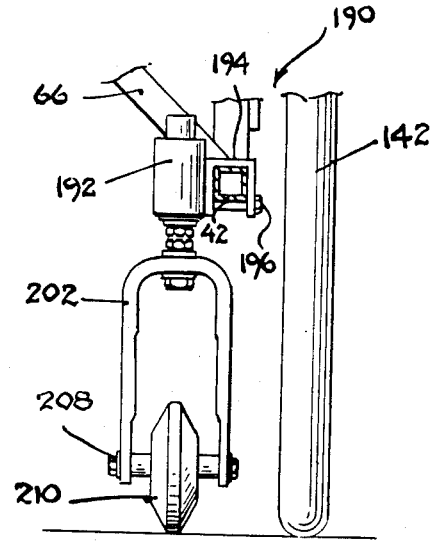
Figure 14:
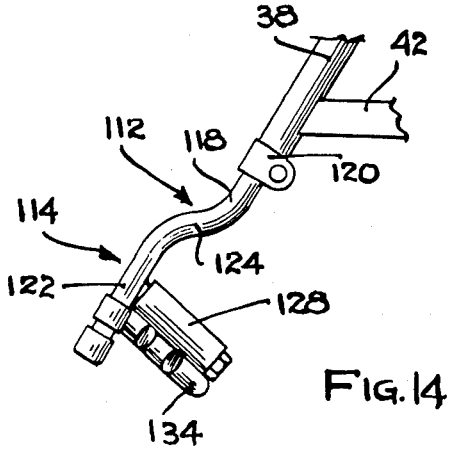
Figure 6:
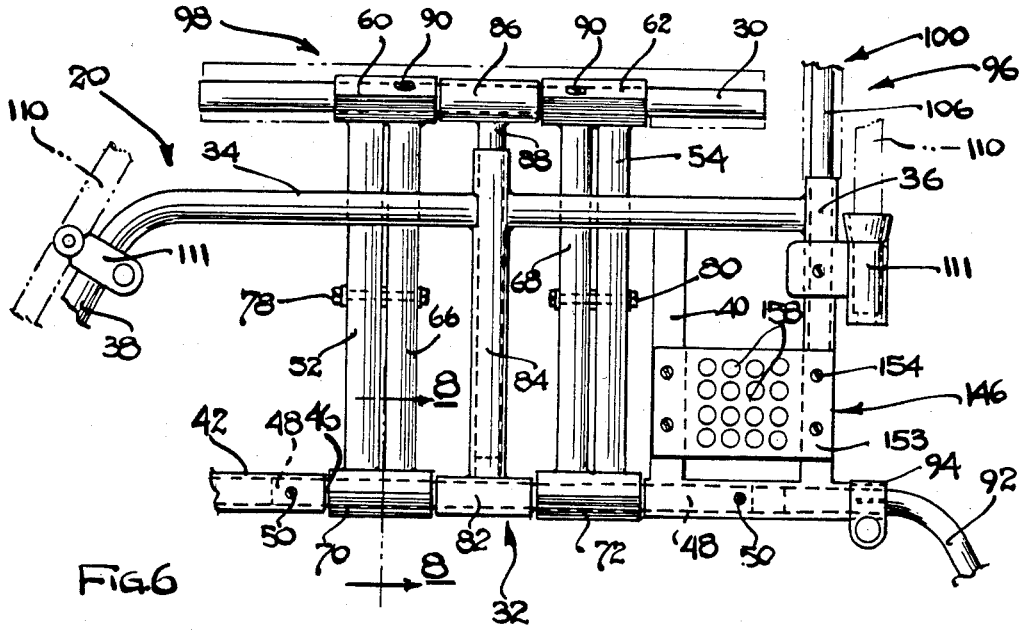
Figure 7:
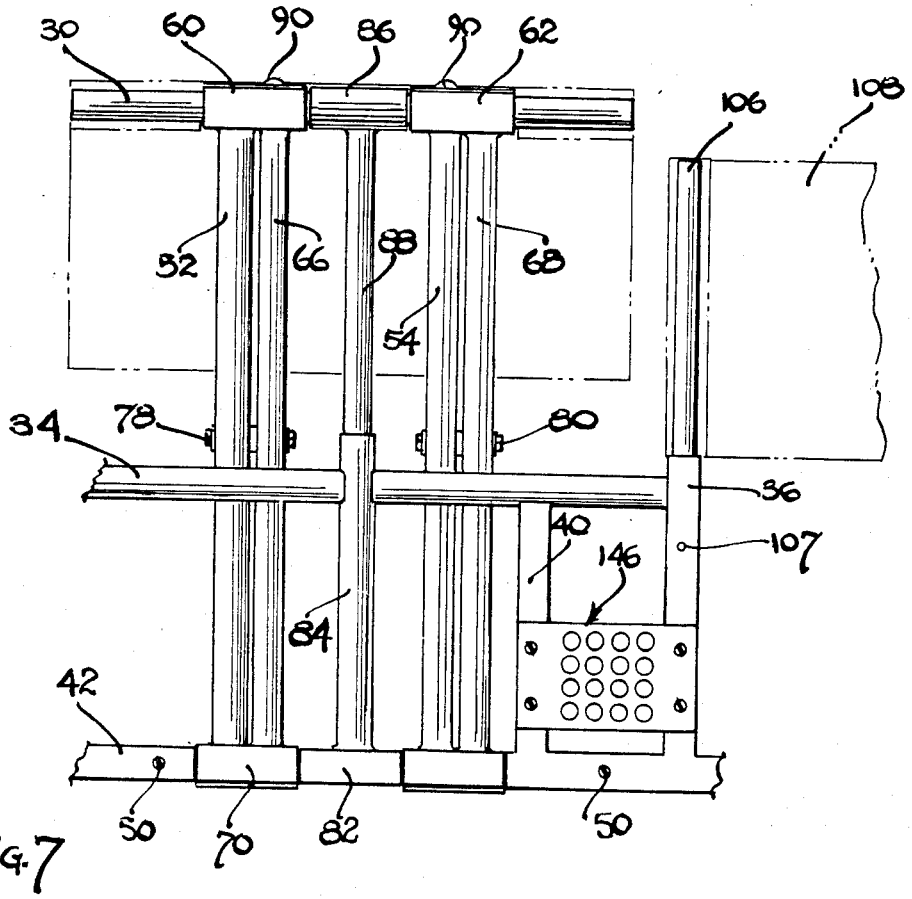
Figure 9:
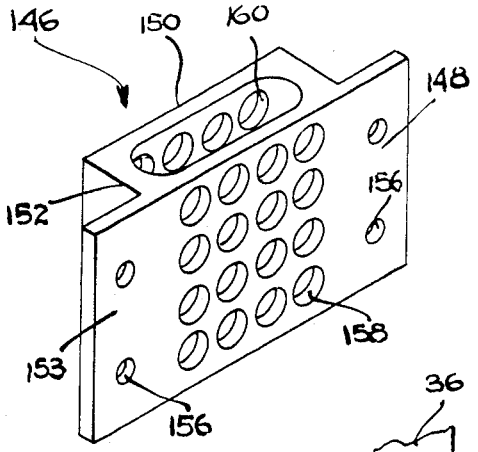
Figure 10:
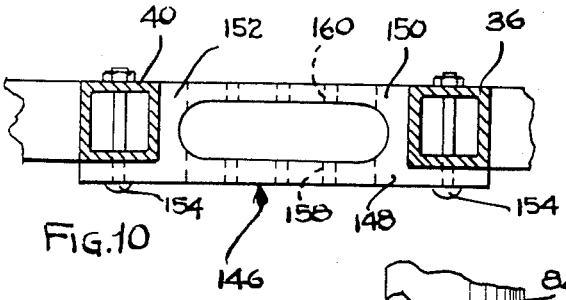
Figure 8:
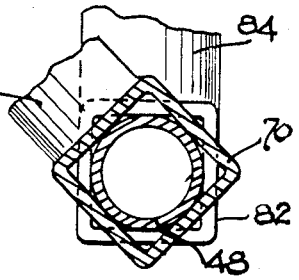
Figure 11:
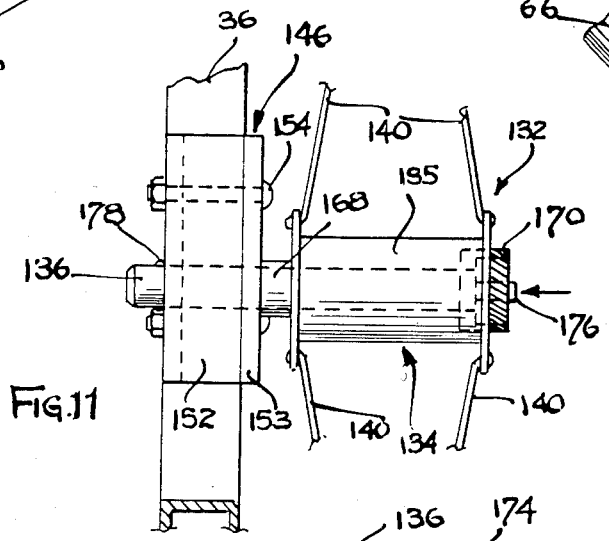
Figure 12:
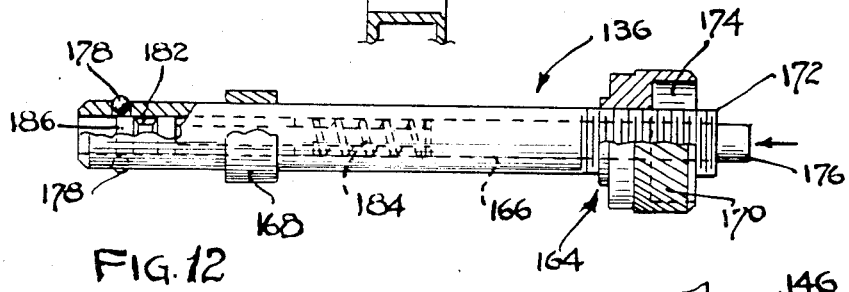
Figure 13:
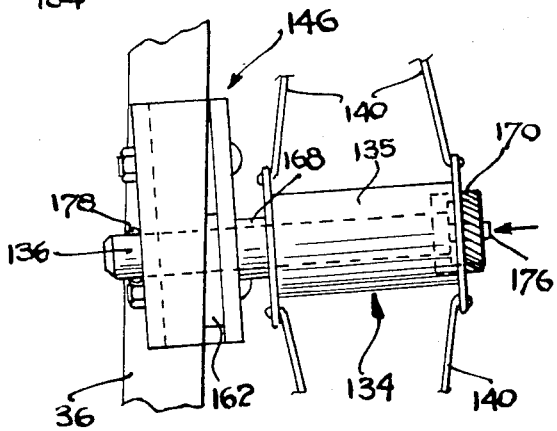

Having thus described the invention in general terms, reference will now be made to the accompanying drawings (seven sheets) in which:

FIG. 1 is a side elevational view of a wheelchair constructed in accordance with and embodying the present invention and being shown in the opened position;

FIG. 2 is a front elevational view of the wheelchair of FIG. 1 in the opened position;

FIG. 3 is a side elevational view showing the wheelchair in the folded position;

FIG. 4 is a front elevational view of the wheelchair in the folded position;

FIG. 5 is a perspective view of a main frame forming part of the wheelchair of the present invention;

FIG. 6 is a fragmentary side elevational view, partially broken away, and showing the positions of several of the elements forming part of the main frame means of the wheelchair, when in the opened position;

FIG. 7 is a fragmentary side elevational view, partially broken away, and showing the positions of several of the elements forming part of the main frame means, when in the folded position;

FIG. 8 is a fragmentary vertical sectional view taken along line 8—8 of FIG. 6;

FIG. 9 is a perspective view of a mounting bracket for mounting the rear wheels to the frame of the wheelchair;

FIG. 10 is a top plan view, partially broken away and in section showing the attachment of the rear wheel mounting bracket to the main frame of the wheelchair;

FIG. 11 is a fragmentary elevational view showing the mounting of a rear wheel to a mounting bracket and hence the main frame of the wheelchair;

FIG. 12 is a side elevational view, partially broken away and in section, and showing a quick release means for removably locking a rear wheel to a wheelchair;

FIG. 13 is a fragmentary front elevational view, somewhat similar to FIG. 11, and showing the means for mounting the rear wheel to the mounting bracket and hence the main frame of the wheelchair in a cambered position;

FIG. 14 is a fragmentary side elevational view showing a foot supporting member used with the wheelchair in an alternate position, when compared to the position illustrated in FIGS. 1–4; and FIG. 15 is a fragmentary front elevational view showing a mounting of a front wheel to the main frame of the wheelchair in an alternate position compared to that of FIGS. 1–4.

DETAILED DESCRIPTION OF PREFERRED EMBODIMENTS

Referring now in more detail and by reference characters to the drawings which illustrate practical embodiments of the present invention, A designates a wheelchair which is capable of being opened for use in normal transport by a user, that is for user transport, as more fully shown in FIGS. 1 and 2. This wheelchair is also capable of being folded for storage and transported (not by a user) e.g. in another vehicle, as more fully illustrated in FIGS. 3 and 4 of the drawings.

The wheelchair A generally comprises a main frame 20 having a pair of opposed and normally spaced apart and parallel frame sections, such as a right-hand frame section 22 and a left-hand frame section 24. The right-hand frame section 22, reference being made to FIGS. 2, 4 and 5 of the drawings may, for example, be referred to as the first frame section and the other frame section 24, that is the left-hand frame section, may be referred to as the second frame section. The left and right sides and frame sections of the wheelchair are deemed to be "left" and "right" when viewed by an occupant of the wheelchair. The main frame 20 may include or may coact with an upper frame structure 26, generally comprised of a pair of longitudinally extending spaced apart upper frame bars or rods 28 and 30. It can be observed that the upper frame bar 28 of the upper frame structure 26 is generally parallel to and extends above the first frame section 22. In like manner, the upper frame bar 30 is parallel to and generally extends immediately above the second frame section 24. These frame bars 28 and 30 are each preferably circular in cross-sectional shape.

Each of the main frame sections 22 and 24 are substantially identical in their construction. Each of the main frame sections 22 and 24 comprise a main frame member or leg 32 and a top horizontal frame member or leg 34 and these frame legs 32 and 34 are connected at their rearward ends by generally upright legs 36 and at their front ends by a generally upright legs 38. In this respect, the front legs 38 are actually angulated, in the manner as more fully illustrated in FIG. 5. However, they do, in effect, serve to connect the upper and lower frame bars 32 and 34 together and therefore, are considered to be generally upright. Intermediate vertically disposed posts 40 also extend between the top frame members 34 and the lower frame members 32 and are spaced from the rear legs 36 for reasons which will presently more fully appear.

Each of the lower frame members 32 is comprised of an initial generally rectangularly shaped, longitudinally extending (that is from front to rear) frame bar 42, which is cut away and removed thereby providing a removed portion, leaving opposed ends 46. Inserted within the region of the removed portion of the lower frame bar 42 is a cylindrically shaped metal tube 48 having portions extending within the opposed ends 46 of the lower frame bar 42 and retained therein by means of retaining screws 50, in the manner as illustrated in FIGS. 6 and 7 of the drawings. This metal tube 48 is preferably of circular cross-sectional shape.

As shown in FIG. 5, pivotally mounted on the metal tube 48 of the right-hand frame section are a first pair of connecting lever arms or so-called "connecting rods" 52 and 54. These connecting rods 52 and 54 are each provided at their lower ends with rectangularly shaped tubular mounting sleeves or collars 56 and 58, respectively, and which are retained by and disposed about the metal tube 48, as more fully illustrated in FIGS. 6, 7 and 8 of the drawings. In like manner, the upper ends of each of these first pair of connecting rods 52 and 54 are provided with non-circular and preferably rectangularly shaped sleeves, 60 and 62 which are disposed about and retained on the cylindrically shaped (left-hand) upper frame bar 30.

A second pair of cross-lever arms or so-called "connecting rods" 66 and 68 are also provided and include at their lower left-hand ends, rectangularly shaped sleeves 70 and 72 which are disposed about the cylindrically shaped metal tube 48 on the second or left-hand frame section 24. At their upper ends, the second pair of connecting rods 68 are similarily provided with rectangularly shaped tubular sleeves 74 and 76 and which are similarily disposed about and retained on the right-hand upper frame bar 28, also in the manner as illustrated in FIG. 5.

By further reference to FIGS. 5–7 of the drawings, it can be observed that the cross-lever arms 52 and 66 are fairly closely spaced relative to one another and similarly, the cross lever arms 54 and 68 are in fairly closely spaced relation to one another. The distance between each of these connected cross-lever arms is substantially less than the overall length of the two frame sections. In addition, it has been found to be highly desirable to position these cross-lever arms intermediate the front and rear portions of the main frame sections, as opposed to being located at the front and rear portions of the main frame sections.

The relatively simple construction of using generally non-circular shaped tubular bars, as for example, rectangularly shaped tubular bars, as sleeves to be fitted around circularly shaped tubular bars, permits a relatively friction free or relatively non-binding bearing arrangement. Thus, the upper frame bars 28 and 30 function as bearings and the cylndrically shaped metal tubes 48 function as bearings on the lower frame members 32.

The forward or first connecting rod 52, of the first pair of connecting rods, is pivotally connected to the first connecting rod 66, of the second pair of connecting rods, intermediate the upper and lower ends of each of said rods, by means of a pivot element 78. In like manner, the rearward or second connecting rods of the first and second pairs 54 and 68 are also connected intermediate their upper and lower ends, by a pivot element 80. These pivot elements 78 and 80 are preferably located approximately midway between the upper and lower ends of each of the various connecting rods and include an elongate shank having enlarged heads on each of the opposite ends thereof.

Located between the rectangularly shaped tubular sleeves 56 and 58 on the lower frame member of the first or right-hand frame section 22, and similarily located between the rectangularly shaped tubular sleeves 70 and 72 on the lower frame member of the second or left-hand frame section 24, are rectangularly shaped collars 82 for supporting vertically disposed cylindrically shaped riser tubes 84. A cylindrically shaped mounting sleeve 86 is disposed about the upper supporting bar 28 and is located between the rectangularly shaped sleeves 74 and 76. In like manner, a cylindrically shaped mounting sleeve 86 is disposed about the upper frame bar 30 betwen the rectangularly shaped tubular sleeves 60 and 62.

Each of the mounting sleeves 86 are diametrically larger than the frame bars 28 and 30 so as to be arcuately movable and thereby function as bearings. Each of these mounting sleeves 86 have vertically disposed telescopically moveable connecting posts 88 which extend within the riser tubes 84. Thus, as the frame is shifted to the opened position, as illustrated in FIGS. 5 and 6, the telescopic connecting posts 88 will extend downwardly within the riser tubes 84. In like manner, when the wheelchair is shifted to its folded position, the telescopic connecting posts 88 will rise upwardly and portions of each of the posts 88 thereof will extend outwardly of the riser tubes 84.

It can be observed that only a relatively simple construction is required to permit the two wheelchair main frame sections to open and close relative to one another. Moreover, by the simple use of rectangular and non-rectangular tubular members, a relatively inexpensive but highly effective mechanism which permits easy foldig and opening of the wheelchair is provided. In addition, it can be observed that only one T-fitting is required, as for example, the mounting sleeves 86 and the telescopic connecting posts 88, on each of the opposite sides of the wheelchair. These T-fittings are usually one of the more expensive components in the frame of a foldable wheelchair. In the prior art wheelchair constructions, it was necessary to employ a pair of T-fittings on each of the opposite sides of the wheelchair or a total of four T-fittings, thereby materially increasing the cost of construction of the prior at wheelchairs.

Inasmuch as the sleeves 74 and 76 do not have to rotate with respect to the upper frame bar 28 and also since the sleeves 60 and 62 do not have to rotate with respect to the upper frame bar 30, they are affixed thereto by means of set screws 90 as illustrated in FIG. 6 of the drawings. In this way the sleeves 74 and 76 restrain axial movement of the upper frame bars 28 and 30 from axial movement and thereby also restrain the mounting sleeve 86 from axial movement on the frame bar.

The various components forming part of each of the main frame sections are welded to one another. Further, the various bars and posts forming part of each of the main frame are preferably tubular. In this respect, the term "bar" does not imply that it is a solid member but rather, it can be either a solid member or it may be tubular or of any other cross-sectional shape. Further, the major components forming part of the main frame may be formed of various metals, such as steel, stainless steel, aluminum or the like. In one of the more preferred embodiments of the invention, each of these components are preferably formed of aluminum or titanium in order to provide the lightweight to the wheelchair and also to provide the necessary rigidity. In addition, these metals also permit wheelchairs to withstand a substantial amount of physical abuse, as for example, that kind of abuse encountered in sports activities.

The lower frame members 32 of each of the frame sections are typically of tubular construction, as aforesaid. Furthermore, the rectangularly shaped tubular lower frame bars 42 of these lower frame members 32 are opened at their rearward ends. Provided for disposition in each of the opened rearward ends of the frame bars 42 of the lower frame members 32 are rearwardly and downwardly extending safety braces 92 having lower ends spaced upwardly from the ground or other supporting surface. The lower ends of these safety braces 92 are adapted to engage the ground or riding surface and prevent inadvertent back tipping of the wheelchair, particularly in certain sports activities. Each of these safety braces 92 may be adjustably retained in the opened ends of the lower frame members 32 by means of C-clamps 94, as illustrated in FIG. 6 of the drawings. It should also be understood that rollers could be mounted at the lower ends of these safety braces 92, if desired.

The wheelchair is suitably provided with a seat structure 96 and which includes a buttocks supporting section 98 and a back supporting section 100, as best seen in FIGS. 1–3 and 6. The buttocks supporting section 98, in one embodiment of the invention, may include a flexible pad 102 which has portions draped around each of the upper frame bars 28 and 30 and which portions are then secured to the underside of the pad by means of lines of stitching 104, or the like.

Further, it can be observed that the seat pad 102 also functions to control the extended or separated limit of the two frame sections 22 and 24 when the main frame is opened. It should be understood that rigid plates could be secured to each of the upper frame bars 28 and 30 and hingedly connected at their center portions for being folded upwardly when folding the wheelchair. These rigid seat supporting plates could be provided with pads for providing a more comfortable seat. This might be desirable in the case where the wheelchair is not to be used in sports activities.

In the embodiment as illustrated the upper frame structure 26 also functions as the seat supporting structure for the lower or buttocks supporting section 98. However, it should also be understood that an additional seat supporting structure could be provided for supporting the buttocks supporting section 98.

The seat back supporting section 96 comprises a pair of vertically disposed posts 106 which are adapted to be inserted into the opened upper ends of each of the frame section legs 36. Moreover, these posts 106 can be secured in the legs 36 at a desired position by means of set screws 107 extending through the legs 36 and the posts 106. A flexible back supporting pad 108 can then be extended between each of the vertically disposed posts 106 and may be secured about the posts 106, much in the same manner as the seat pad 102 was secured to the upper frame bars 28 and 30.

In accordance with the above-outlined construction, it can be observed that the overall height of the seat supporting structure, which in this case may be the upper frame structure 26, can be regulated by the size of the connecting rods which may be employed. Notwithstanding, it can also be observed that the position of the back can be easily adjusted by merely releasing the set screws 107, raising or lowering the posts 106, and reinserting the set screws 107 in the desired locations. By using flexible pads such as the pads 102 and 108, it can be observed that they open and provide support when the main frame is opened, as illustrated in FIGS. 1 and 2, and will shift out of the way when the main frame is folded.

The wheelchair may also be provided with arms 110 (illustrated in phantom lines in FIG. 1, since they are optional). These arms 110 would be adapted to have their lower ends extend into cups 111 (FIG. 6) secured to the uprights or legs 36 at the rear of the wheelchair and the uprights or legs 38 at the front of the wheelchair.

The wheelchair A is also provided with a foot supporting structure 112 which is more fully illustrated in FIGS. 1–4 and 14 of the drawings. In this embodiment of the wheelchair, the foot supporting structure includes a pair of individual foot supports such as a right foot support 114 and a left foot support 116. The left foot support 116 can actually be mounted on the right side of the wheelchair and accordingly the right foot support can be mounted on the left side of the wheelchair, as hereinafter described. The left foot support 116 is effectively a mirror image of the right foot support 114.

The left foot support 116 generally comprises a tubular post 118 which is adapted to extend within the lower end of the front generally upright leg 38 of the left-hand frame section 24. Moreover, the tubular post 118 may be retained therein by means of a C-clamp 120.

The right foot support member 114 would be mounted to the right frame section 22 in the same manner, by having its tubular post 118 extend within the front leg 38. It can be observed that the overall length of the foot support member 114 relative to the user can be adjusted by regulating the depth of insertion of the posts 118 within the generally upright tubular legs 38. An offset post 122 is integral with the main post 118 through an S-section 124, in the manner as illustrated in FIG. 1. The lower end of the post 122 is provided with a cap 126 which is adapted to engage the ground or other supporting surface when the wheelchair is tipped forwardly in order to prevent inadvertent tipping over of the wheelchair and the occupant thereof. It should be understood that a roller could also be mounted at the lower end of this foot support member, if desired.

Also mounted on the offset post 122 is a hinge mechanism 128 which carries a generally U-shaped foot receiving element 130. The hinge mechanism 128 is adapted to permit the foot receiving element 130 to extend inwardly with respect to the wheelchair in a generally horizonital plane. Moreover, the hinge mechanism is operable to permit this foot receiving member 130 to be pivoted upwardly approximately 90 degrees so that it lies in a generally vertical plane for purposes of folding the wheelchair.

The right foot support member 114 is substantially identical to the left foot support member 116 except that the right foot support member also has the generally U-shaped foot receiving element 130 extending inwardly as well. Consequently, since each foot support 114 and 116 has the foot receiving elements 130 extending inwardly, the two individual foot supporting members 114 and 116 are required.

It is possible to reverse the positions of the individual foot support members 114 and 116 so that the foot support member 116 is located on the right side of the wheelchair and the foot support member 114, normally on the right side of the wheelchair, would be located on the left side of the wheelchair. Such an arrangement is more fully illustrated in FIG. 14 of the drawings. In this case, it can be observed that the left foot support member, which is now on the right hand side, will have the offset post 122 located forwardly of the plane of the generally upright leg 38. However, in the previous arrangement of the foot support members 114 and 116, the offset leg 122 was located rearwardly of the plane of the leg 38, as for example in FIG. 1 thereof. In accordance with this construction, it is possible to locate the foot receiving elements 130 closer to or further from the occupants of the wheelchair. Further, since the foot receiving element 130 is actually slightly angulated with respect to the offset post 122 to which it is secured, the angular position of the foot receiving element is also changed when the right foot support is substituted for the left and the left is substituted for the right.

The wheelchair A is also provided with a pair of rear wheels 132 and which are retained on the frame sections 22 and 24 of the main frame 20 by means of rear wheel mounting assemblies 134, which are more fully illustrated in FIGS. 1–3 and 9–13 of the drawings. The rear wheels 132 each comprise a center hub 135 which is capable of receiving a rear wheel axle 136, as hereinafter described in more detail. The center hub 135 is connected to a relatively rigid rim 138 by means of a plurality of spokes 140. Suitably mounted on the rim 138 is a tire, which is preferably a rubber tire 142. In a conventional manner, it is preferable to have the tire 142 removably mounted, e.g. an inflatable tire, for purposes of replacement. Also suitably mounted on each of the rims 138 of the wheels 132 is a circumferentially extending hand engagable ring 144 which is adapted to be engaged by the hands of the user for causing rotation of the wheels about their central axis to thereby propel the wheelchair.

As indicated, a pair of rear wheel mounting assemblies 134 are provided with one for each side of the wheelchair. Each rear wheel mounting assembly preferably comprises a mounting bracket 146, (FIGS. 5, 6 and 9–11). One bracket 146 would be mounted to each of the main frame sections 22 and 24 of the wheelchair. The brackets 146 are mounted to the rear upstanding legs 36 and the intermediate upstanding legs 40, in the manner as illustrated in FIGS. 5–7 and 10 of the drawings.

Each of the mounting brackets 146 is provided with a face plate 148 and a spaced apart mating plate 150 connected to the plate 148 by means of a pair of rearwardly extending integral side plates 152. Moreover, the face plate 148 is provided with integral mounting flanges 153 on each of the opposite sides thereof which are secured to the upstanding legs 36 and 40 by means of sheet metal screws, bolts or similar fasteners 154. For this purpose, the flanges 153 are provided with a plurality of bolt receiving apertures 156, in the manner as illustrated in FIG. 9 of the drawings. Further, it can be observed that the inwardly located mating plate 150 has a smaller size than the plate 148 so as to be snugly disposed between the two upstanding legs or posts 36 and 40.

Each of the plates 148 and 150 are provided with a plurality of sets of aligned apertures or openings 158 and 160 for receiving one of rear wheel axles 136. These apertures 158 and 160 define rear wheel axle receiving locations such that the rear wheel axles 136 can be located in any of the sets of openings 158 and 160.

By reference to FIGS. 1–4 it can be observed that the mounting brackets 146 are located so that the integral plates 148 and 150 will be vertically disposed. In this way the rear wheels will be vertically disposed, as shown.

By reference to FIG. 13 of the drawings, it can be observed that the mounting bracket 146 can be canted somewhat such that the rear wheel axle 136 is also located at an angular relationship with respect to a true horizontal. In this way, the rear wheels 132 are canted somewhat. The canting arrangement of the mounting brackets 146 may be obtained by using one or more shims 162, in the manner as illustrated in FIG. 13. In this way, the mounting bracket 146 is angulated away from the true vertical position, and hence, the axle 136 is located so that the rear wheels are canted with the upper ends of the wheels being located inwardly and the lower ends of the wheels being struck outwardly. It has been found in connection with the present invention, that in some situations, it is desirable to cant the wheels in this fashion in order to provide greater stability to the wheelchair, particularly when the latter is used in sports activities such as racing events, and the like. The rear wheels may be cambered at an angle of about 0 degrees to about 10 degrees per wheel from a truly vertical position, and preferably, from an angle of about 3 degrees to about 5 degrees per wheel in order to achieve the most desirable results.

Along with the cambering of the rear wheels, these wheels can also be toed inwardly or outwardly by using shims (not shown) on the mounting brackets 146. Typically, it is desirable to toe the rear wheels outwardly when the rear wheels are cambered. Preferably, the rear wheels should be towed out at a ratio of one-third of the camber. Thus, for example, for every degree of camber, there should be a toe-out of about one-third degree.

The rear wheel axles 136 form part of a quick release locking mechanism 146 which is more fully illustrated in FIGS. 11 and 12 of the drawings. The quick release lock mechanism includes a pin 166 which is concentrically located within a centrally located axially extending bore in the axle 136. In addition, an outer spacer sleeve 168 is disposed upon the axle 136 for maintaining clearance between the wheels and frame when the axle 136 is positioned in the bracket 146. Further, a locking collar 170 having a knurled outer surface is also threadedly disposed on the threaded right-hand end 172 of the axle 136. Thus, by adjusting the locking collar 170, it is possible to eliminate excess axial play or movement.

The locking collar 170 is provided with an outwardly facing recess 174 and which receives an outwardly extended end 176 of the release pin 166. This outwardly extending end 176 functions as a release button which is manually actuable to axially displace the pin 166 to thereby release a pair of locking elements, such as detent balls 178, at the left-hand end of the axle 136, reference being made to FIG. 12. Further, the release pin 166 is provided with an annular groove 182, such that when the pin 166 is pushed inwardly, the groove 182 becomes aligned with the balls 178 permitting them to fall inwardly. However, when the release pin 166 is biased to the right (FIG. 12) by means of a compression spring 184, the balls are displaced by a shoulder, 186 thereby biasing the balls 178 outwardly.

The spacer sleever 168 is adapted to fit between the interiorally presented surface of the hub 135 and the exterior face 148 of the bracket 146. The axle 136 can be tightened within the bracket when the hub 135 is mounted thereto by threadedly turning the knurled locking collar 170. Moreover, it can be observed that the axle can be relatively small and protrudes only very slightly beyond the interior face of the plate 150. Thus, no interference is created by the axles when the wheelchair is in the folded condition. The pin 176 also protrudes only very slightly beyond the locking collar 170. It is possible to provide a locking collar with sufficient depth so that the outer end 176 of the pin does not extend beyond the recess 174.

When it is desired to mount a rear wheel 132 in any of the rear wheel locations, the pin 166 can be pushed inwardly in the axle 136, thereby permitting the locking elements 178 to fall radially inwardly toward the center of the axle. This will permit the axle to be removed from any of the aligned apertures 158 and 160. Moreover, the axle can then be removed from the hub 134 of the rear wheels. In like manner, when it is desired to mount the rear wheel on the wheelchair, the release pin 166 is pushed inwardly by manually engaging the outer end 176. Again, the locking elements 178 will be permitted to fall radially inwardly permitting the hub 134 to be mounted on the axle 136 and also permitting the axle to be re-inserted through the aligned apertures 158 and 160. Thus, when the outer end 176 is released and the release pin 166 is biased to the right, by means of the compression spring 184, the locking elements 178 will be biased outwardly thereby engaging the rear surface of the plate 150 and retentively locking the rear wheel onto the wheelchair.

It can be observed by means of the above construction, that it is possible to selectively position the rear wheels on the wheelchair frame. By positioning the rear wheels so that they are located in the lower and rearwardmost corner of the brackets 146, the wheelchair will assume a more standard riding position in the same manner as conventional wheelchairs. Thus, the wheelchair will function for normal day to day activity. By positioning the axle in the upper and forwardmost apertures 158 and 160 of the bracket 146, the rear portion of the wheelchair will be effectively shifted upwardly thereby raising the center of gravity. However, this is desirable in some situations. Thus, the center of gravity of the wheelchair can be easily altered. In addition, by shifting the rear wheel axles either rearwardly or forwardly in any of the selected axle receiving locations, it is also possible to effectively change the overall wheelbase of the wheelchair in order to obtain the desired riding characteristics.

At the forward portion of the wheelchair A, on each of the opposite frame sections 20 and 22, are front wheel assemblies 190 and which are more fully illustrated in FIGS. 1–5 and 15 of the drawings. Each front wheel assembly 190 generally comprises a mounting hub 192 which is rigidly secured to an inverted U-shaped bracket 194 as best seen in FIG. 15. In this case, the bracket 194 is adapted to be disposed over the longitudinally extending lower frame bars 32 on each of the frame sections 22 and 24. Moreover, the mounting hub 192 may be secured in a selected position along the longitudinally extending lower frame bar 32 by means of a bolt 196 which extends through the bracket 194 and into the mounting hub 192.

Disposed within and extending downwardly from the mounting hub 192 is vertically positioned rod or axle 198 and which also extends through a spacing collar 200 abutted against the lower end of the hub 192. The rod 198 is, in turn, secured at its lower end to a wheel supporting yoke 202 which is generally of an inverted U-shape, as also seen in FIG. 2 of the drawings. The wheel mounting yoke 202 is provided with a first pair of lower axle receiving apertures 204 and an upwardly located second pair of axle receiving apertures 206. In this case, each of the apertures in the respective pairs 204 and 206 are located on opposite sides of the wheel mounting yoke 202. A conbination of a wheel axle 208 and a front wheel 210 is mounted in the pairs of upper apertures 206 or the lower apertures 204, as shown, on each of opposite sides of the wheelchair.

The second pair of apertures 206 which are located upwardly from the lower pair 204 are adapted to receive axles 208 and wheels 210 of larger diameter. In this way, the front wheels can either be mounted in the upper apertures 206, such that a forward tilt is provided to the wheelchair, or otherwise, larger wheels could be so mounted. It should be understood that additional pairs of apertures could be provided in each of the wheel mounting yokes 202 as may be desired in order to further adjustably position the wheels, or to otherwise, provide for different diameter wheels.

By means of the above construction, it can be observed that the front wheels can be shifted closer to or further from the rear wheels in order to change the overall wheel base of the wheelchair. Further, the shifting of the front wheels relative to the rear wheels may also affect the angle of attack of the wheelchair, as hereinafter described in more detail. Thus, for example, if the rear wheels are changed in vertical position, the position of the front wheels relative to the rear wheels will affect the angle of attack.

By further reference to FIGS. 1–4 and 15 of the drawings, it can be observed that the front wheel assemblies 190 and hence the front wheels 210 can be reversed so as to be located either inwardly or outwardly of the main frame 20. FIG. 2 illustrates the front wheels or so-called "casters" mounted exteriorly on the opposite longitudinal sides of the frame sections 22 and 24. by merely loosening the bolt 196 and removing the bracket 194, it is possible to rotate each of the front wheel assemblies and mount them on the interior of the lower frame bars 42, as illustrated in FIG. 15 of the drawings. This latter arrangement is preferred when the wheelchair is to be used in athletic activities in order to provide greater clearance, as for example, in bouncing a basketball, moving a tennis racket, or the like. In this way, the front wheels will not interfere with any moving object or a moving arm of the user of the wheelchair.

Thus, there has been illustrated and described a unique and novel wheelchair which is collapsable for transport or storage and expandable for use in either normal user transport or sports activities. This wheelchair can be constructed of several different sizes from standard sized component sets and which is capable of functioning for conventional movement as well as for athletic activities, and which therefore fulfills all of the objects and advantages sought therefor. It should be understood that many changes, modifications, variations, and other uses and applications will become apparant to those skilled in the art after considering this specification and the accompanying drawings. Therefore, any and all such changes, modifications, variations, and other uses and applications which do not depart from the spirit and scope of the invention are deemed to be coverd by the invention which is limited only by the following claims.

Having thus described my invention, what I desire to claim and secure by Letters Patent is:

1. A wheelchair which is foldable and collapsible for storage and transport and which is openable for use, said wheelchair comprising:

(a) a pair of opposed first and second frame sections, (b) a seat structure connected between said first and second frame sections and each capable of being juxtaposed relative to one another when the wheelchair is in the folded position, (c) a first pair of spaced apart connecting rods with each pivotally connected to a lower portion of said first frame section at spaced apart locations between the front and rear of the wheelchair, said first pair of connecting rods also being connected to said seat structure at a pair of spaced apart points generally upwardly of the second frame section, (d) a second pair of spaced apart connecting rods pivotally connected to a lower portion of said second frame section at spaced apart locations between the front and rear of the wheelchair, said second pair of connecting rods also being connected to said seat structure at a pair of points generally upwardly of said first frame section, (e) first pivot means for pivotally connecting one of the first connecting rods to one of the second connecting rods intermediate their upper and lower ends, (f) second pivot means for pivotally connecting the other rod of the first pair of connecting rods to the other rod of the second pair of connecting rods intermediate their upper and lower ends, whereby said frame sections can be shifted apart to the opened position for use and shifted together to the folded position, (g) first telescoping connecting means located between said pairs of connecting rods between the front and rear of the wheelchair and operatively connecting a side of the seat structure above the first frame section to the first frame section, and (h) a second telescoping connecting means located between said pairs of connecting rods between the front and rear of the wheelchair and operatively connecting a side of the seat structure above the second frame section to the second frame section.

2. The wheelchair of claim 1 further characterized in that only one telescoping connecting means connects the first frame sections to a side of the seat structure and which connecting means consists of the first telescoping connecting means, and only one second telescoping connecting means connects the second frame section to a side of the seat structure and which consists of the second telescoping connecting means.

3. The wheelchair of claim 2 further characterized in that said connecting rods have their upper ends connected to rigid members which also support and form part of said seat structure.

4. The wheelchair of claim 1 further characterized in that said seat structure is separate from and vertically moveable relative to said first and second frame sections.

5. The wheelchair of claim 4 further characterized in that said seat structure comprises:

(1) a buttocks supporting section connected between the first and second frame sections and capable of being collapsed when the wheelchair is in the folded position and expanded when in the opened position, and (2) a back supporting section connected between the first and second frame sections and capable of being collapsed when the wheelchair is in the folded position and expanded when in the opened position.

6. A wheelchair which is foldable and collapsible for storage and transport and which is openable for use, said wheelchair comprising:

(a) a pair of opposed first and second frame sections, (b) a seat structure connected between said first and second frame sections and each capable of being juxtaposed relative to one another when the wheelchair is in the folded position, (1) a buttocks supporting section connected between the first and second frame sections and capable of being collapsed when the wheelchair is in the folded position and expanded when in the opened position, and (2) a back supporting section connected between the first and second frame sections and capable of being collapsed when the wheelchair is in the folded position and expanded when in the opened position, (c) a first pair of spaced apart connecting rods with each having lower ends pivotally connected to a lower portion of said first frame section at spaced apart locations between the front and rear of the wheelchair, said first pair of connecting rods also having upper ends connected to said seat structure at a pair of spaced apart points generally upwardly of the second frame section, (d) a second pair of spaced apart connecting rods having lower ends pivotally connected to a lower portion of said second frame section at spaced apart locations between the front and rear of the wheelchair, said second pair of connecting rods also having upper ends connected to said seat structure at a pair of points generally upwardly of said first frame section, said first and second pairs of connecting rods being spaced closely to one another relative to the overall length of said first and second frame sections, such that the lower ends of the first pair of connecting rods are closely spaced to one another and the upper ends of the first pair of connecting rods are closely spaced to one another and the lower ends of the second pair of connecting rods are closely spaced to one another and the upper ends of the second pair of connecting rods are closely spaced to one another, to thereby reduce diagonal flex and vertical flex and horizontal flex during opening and closing of said wheelchair and for providing support during use, (e) first pivot means for pivotally connecting one of the first connecting rods to one of the second connecting rods intermediate their upper and lower ends, and (f) second pivot means for pivotally connecting the other rod of the first pair of connecting rods to the other rod of the second pair of connecting rods intermediate their upper and lower ends, whereby said frame sections can be shifted apart to the opened position for use and shifted together to the folded position.

7. The wheelchair of claim 6 further characterized in that said wheelchair has a pair of rear wheels and a pair of front wheels, said pair of rear wheels are canted so that the lower edges are spaced outwardly relative to the wheelchair and the upperedges are spaced inwardly and closer toward the frame sections of said wheelchair.

8. The wheelchair of claim 7 further characterized in that separate bracket means is mounted on each of the first and second frame sections for mounting rear wheels thereto, each of said separate bracket means being canted so that the rear wheels mounted thereon are chambered so that the lower edges are spaced outwardly relative to the wheelchair and the upper edges are spaced inwardly and closer toward the frame sections of the wheelchair.

9. The wheelchair of claim 6 further characterized in that each of said frame sections is constructed essentially of tubular metal members.

10. The wheelchair of claim 6 further characterized in that each of said frame sections is constructed essentially of generally circularly shaped tubular metal members and generally rectangularly shaped tubular metal members.

11. The wheelchair of claim 6 further characterized in that each of said frame sections have generally upright front portions which have lower ends, and a foot support means is adapted to telescopically attach to said lower ends of said front portions.

12. The wheelchair of claim 11 further characterized in that each of said frame sections has generally upright back portions which have upper ends and said seat structure has generally vertically disposed members adapted to be telescopically attached to the upper ends of said back portions.

13. The wheelchair of claim 12 further characterized in that said foot support means has legs adapted to telescopically fit within lower ends of said front portions.

14. A wheelchair which is foldable and collapsible for storage and transport and which is openable for use, said wheelchair comprising:

(a) a pair of opposed first and second frame sections capable of being shifted apart to an opened position and to a closed position where they lie in juxtaposed relationship, (b) an upper frame structure with a first upper frame bar overlying and spaced from the first frame section and a second upper frame bar spaced from the first upper frame bar and overlying and spaced from the second frame section, (c) a first pair of spaced apart connecting rods with each pivotally connected to a lower portion of said first frame section at spaced apart locations between the front and rear of the wheelchair, said first pair of connecting rods also being connected to said second upper frame bar of said upper frame structure at a pair of spaced apart points generally upwardly of the second frame section, (d) a second pair of spaced apart connecting rods pivotally connected to a lower portion of said second frame section at spaced apart locations between the front and rear of the wheelchair, said second pair of connecting rods also being connected to said upper frame bar at a pair of points generally upwardly of said first frame section, (e) first pivot means for pivotally connecting one of the first connecting rods to one of the second connecting rods intermediate their upper and lower ends, (f) second pivot means for pivotally connecting the other rod of the first pair of connecting rods to the other rod of the second pair of connecting rods intermediate their upper and lower ends, whereby said frame sections can be shifted apart to the opened position for use and shifted together to the folded position, (g) first telescopic connecting means extending between said first upper frame bar and said first frame section and so that said first upper frame bar is vertically shiftable relative to and independent of said first frame section when said wheelchair is folded and unfolded, said first telescopic connecting means being located intermediate the ones of said first connecting rods and second connecting rods which are pivotally connected by said first pivot means, and (h) second telescopic connecting means extending between said second upper frame bar and said second frame section so that said upper frame bar is vertically shiftable relative to and independently of said second frame section when said wheelchair is folded and unfolded, said second telescopic connecting means being located intermediate other of said first connecting rods and other of said second connecting rods which are pivotally connected by said second pivot means.

15. The wheelchair of claim 14 further characterized in that said first connecting means comprises a post telescopically extending between said first upper frame bar and said first upper frame section.

16. The wheelchair of claim 15 further characterized in that said second telescopic connecting means comprises a post telescopically extending between said second upper frame bar and said second frame section.

17. The wheelchair of claim 16 further characterized in that said posts are telescopically located within upright tubular members on said first and second frame means and are connected respectively to said first and second upper frame bars.

18. A wheelchair which is foldable and collapsible for storage and transport and which is openable for use, said wheelchair comprising:

(a) a pair of opposed first and second frame sections, (b) a seat structure connected between said first and second frame sections and each capable of being juxtaposed relative to one another when the wheelchair is in the folded position, said seat structure having a first rigid member forming a part thereof and a second spaced apart rigid member forming a part thereof, (c) a first pair of spaced apart connecting rods with each pivotally connected to a lower portion of said first frame section at spaced apart locations between the front and rear of the wheelchair, said first pair of connecting rods also being connected to said seat structure at a pair of spaced apart points generally upwardly of the second frame section, (d) a second pair of spaced apart connecting rods pivotally connected to a lower portion of said second frame section at spaced apart locations between the front and rear of the wheelchair, said second pair of connecting rods also being connected to said seat structure at a pair of points generally upwardly of said first frame section, (e) first pivot means for pivotally connecting one of the first connecting rods to one of the second connecting rods intermediate their upper and lower ends, (f) second pivot means for pivotally connecting the other rod of the first pair of connecting rods to the other rod of the second pair of connecting rods intermediate their upper and lower ends, whereby said frame sections can be shifted apart to the opened position for use and shifted together to the folded position, (g) first telescoping connecting means operatively connecting a side of the seat structure above the first frame section to the first frame section, said first telescopic connecting means comprising a T-shaped fitting having a generally horizontally disposed section operatively connected to said first rigid member forming part of said seat structure and a generally vertically disposed section which is telescopically shiftable, and (h) a second telescoping connecting means operatively connecting a side of the seat structure above the second frame section to the second frame section, said second telescopic connecting means also comprising a T-shaped fitting having a generally horizontally disposed section operatively connected to said second rigid member forming part of said seat structure and a generally vertically disposed section which is telescopically shiftable.

19. The wheelchair of claim 18 further characterized in that said first and second telescoping connecting means being located between said pairs of connecting rods connected respectively by said first and said second pivot means.

20. The wheelchair of claim 19 further characterized in that only one telescoping connecting means connects the first frame sections to a side of the seat structure and which connecting means consists of the first telescoping connecting means, and only one second telescoping connecting means connects the second frame section to a side of the seat structure and which consists of the second telescoping connecting means.

21. The wheelchair of claim 18 further characterized in that said seat structure is separate from and vertically moveable relative to said first and second frame sections.

22. The wheelchair of claim 21 further characterized in that said seat structure comprises:

(1) a buttocks supporting section connected between the first and second frame sections and capable of being collapsed when the wheelchair is in the folded position and expanded when in the opened position, and (2) a back supporting section connected between the first and second frame sections and capable of being collapsed when the wheelchair is in the folded position and expanded when in the opened position.

23. A wheelchair which is foldable and collapsible for storage and transport and which is openable for use, said wheelchair comprising:

(a) a pair of opposed first and second frame sections, (b) a seat structure connected between said first and second frame sections and each capable of being juxtaposed relative to one another when the wheelchair is in the folded position, (1) a buttocks supporting section connected between the first and second frame sections and capable of being collapsed when the wheelchair is in the folded position and expanded when in the opened position, and (2) a back supporting section connected between the first and second frame sections and capable of being collapsed when the wheelchair is in the folded position and expanded when in the opened position.

(c) a first pair of spaced apart connecting rods with each pivotally connected to a lower portion of said first frame section at spaced apart locations between the front and rear of the wheelchair, said first pair of connecting rods also being connected to said seat structure at a pair of spaced apart points generally upwardly of the second frame section, (d) a second pair of spaced apart connecting rods pivotally connected to a lower portion of said second frame section at spaced apart locations between the front and rear of the wheelchair, said second pair of connecting rods also being connected to said seat structure at a pair of points generally upwardly of said first frame section, said first and second pairs of connecting rods being spaced closely to one another relative to the overall length of said first and second frame sections, (e) first guide means on one side of said wheelchair operatively connecting said seat structure to said frame section and being located in closely spaced relation to the pivoted connection of said first pair of connecting rods to said seat structure, (f) second guide means on the other side of said wheelchair operatively connecting said seat structure to said second frame section and being located in closely spaced relationship to the pivoted connection of said second pair of connecting rods to said seat structure, (g) first pivot means for pivotally connecting one of the first connecting rods to one of the second connecting rods intermediate their upper and lower ends, and (h) second pivot means for pivotally connecting the other rod of the first pair of connecting rods to the other rod of the second pair of connecting rods intermediate their upper and lower ends, whereby said frame sections can be shifted apart to the opened position for use and shifted together to the folded position.

24. The wheelchair of claim 23 further characterized in that said first guide means is a first telescopic connecting means comprising a T-shaped fitting having a generally horizontally disposed section operatively connected to a first rigid member forming part of said seat structure and a generally vertically disposed section which is telescopically shiftable, and said second guide means also comprising a T-shaped fitting having a generally horizontally disposed section operatively connected to a second rigid member forming part of said seat structure and a generally vertically disposed section which is telescopically shiftable.

25. The wheelchair of claim 23 further characterized in that said first guide means is a first telescopic connecting means located intermediate said pair of first and second connecting rods which are pivotally connected together, said second guide means is a second telescopic connecting means being located intermediate pairs of said first and second connecting rods which are pivotally connected together.

26. The wheelchair of claim 23 further characterized in that:

(a) said first telescopic connecting means comprising a T-shaped fitting having a generally horizontally disposed section operatively connected to a first rigid member forming part of said seat structure and a generally vertically disposed section which is telescopically shiftable, said first telescopic connecting means also being located intermediate the ones of said first connecting rods and second connecting rods which are pivotally connected by said first pivot means and the other of the first and second connecting rods which are connected by said second pivot means, (b) said second telescopic connected means also comprising a T-shaped fitting having a generally horizontally disposed section operatively connected to a second rigid member forming part of said seat structure and a generally vertically disposed section which is telescopically shiftable, said second telescopic connecting means being located intermediate the first and second connecting rods connected by the first pivot means and the other of said first connecting rods and other of said second connecting rods which are pivotally connected by said second pivot means.

* * * * *